US008727252B1

(12) United States Patent
Phipps

(10) Patent No.: US 8,727,252 B1
(45) Date of Patent: May 20, 2014

(54) ROCK CRUSHER SYSTEM FOR AN EXCAVATOR

(76) Inventor: Jeffrey Sterling Phipps, Tallahassee, FL (US)

( * ) Notice: Subject to any disclaimer, the term of this patent is extended or adjusted under 35 U.S.C. 154(b) by 405 days.

(21) Appl. No.: 13/199,167

(22) Filed: Aug. 23, 2011

(51) Int. Cl.
*B02C 1/06* (2006.01)

(52) U.S. Cl.
USPC ..... 241/101.73; 241/266

(58) Field of Classification Search
USPC ..... 241/101.73, 264–269
See application file for complete search history.

(56) References Cited

U.S. PATENT DOCUMENTS

| | | | | |
|---|---|---|---|---|
| 3,567,050 | A | 3/1971 | Pasquazzi | |
| 4,776,524 | A | 10/1988 | Sakato | |
| 4,799,852 | A | 1/1989 | Ramun | |
| 4,890,798 | A * | 1/1990 | Tagawa et al. | 241/266 |
| 5,301,882 | A | 4/1994 | Morikawa et al. | |
| 5,361,999 | A | 11/1994 | Sakato et al. | |
| 5,704,560 | A * | 1/1998 | Wimmer | 241/266 |
| 5,738,289 | A * | 4/1998 | Tagawa | 241/266 |
| 5,743,476 | A | 4/1998 | Morikawa et al. | |
| 5,769,341 | A * | 6/1998 | Morikawa et al. | 241/266 |
| 6,015,108 | A | 1/2000 | Okumura et al. | |
| 6,766,973 | B2 | 7/2004 | Muri | |
| 6,915,972 | B2 | 7/2005 | Rossi, Jr. | |
| 7,284,718 | B2 * | 10/2007 | Christenson | 241/101.73 |
| 7,311,278 | B2 | 12/2007 | Kitsukawa et al. | |
| 7,971,816 | B2 * | 7/2011 | Andrina | 241/101.73 |
| 8,020,799 | B2 * | 9/2011 | Muraoka | 241/101.73 |
| 2011/0297773 | A1 * | 12/2011 | Nye et al. | 241/101.73 |

* cited by examiner

*Primary Examiner* — Faye Francis
(74) *Attorney, Agent, or Firm* — Peter Loffler

(57) ABSTRACT

A rock crusher is attached to a typical excavator that has a swing boom, an extension arm attached to the swing boom, and a bucket attached to the extension arm. The rock crusher has at least one blade fixedly attached within the bucket's interior and at least one anvil fixedly attached to the extension arm just above the bucket. At least one other blade is pivotally attached to the extension arm as well as to the swing boom via a linkage so that when the extension arm is drawn toward the boom by pulling back on the operator's stick, this second blade is crushingly pressed onto the material within the bucket.

7 Claims, 4 Drawing Sheets

ROCK CRUSHER SYSTEM FOR AN EXCAVATOR

BACKGROUND OF THE INVENTION

1. Field of the Invention

The present invention relates to a rock crushing system that is employed, on a typical excavator wherein the rotation of the bucket as well as the powerful drawing of the extension arm toward the swing boom are used for the crushing of the rocks.

2. Background of the Prior Art

In a typical construction site wherein rocks are present during the site preparation stage, or concrete is present during the demolition phase, the rock (or concrete) is piled up in relatively large chunks and the large chunks are reduced in size for better loading onto and packing within the dump trucks that haul the rocks off to a remote location whereat the smaller rocks are offloaded. A standard tool in crushing larger rocks into smaller rocks is the densifier. The densifier is an excavator-based set of opposing jaws having teeth thereon which grabs large chunks of rock or concrete and crushes the material into smaller chunks in order to allow for better loading and packing onto the dump trucks that haul the material away.

While the densifier is well suited for its primary function of reducing the size of concrete or rocks, it is not particularly well suited for other tasks. A densifier may be able to load a dump truck with the reduced material if the truck is on hand by simply performing the crushing of the material over the bed of the truck. However, as is often the case, the densifier is tasked with reducing a mound of material prior to dump trucks being on site. The pile of relatively larger material is crushed and placed into a pile of relatively smaller material. Subsequent to the pile formation, the smaller material is loaded onto the dump trucks for removal, possibly being reduced even further by a smaller crusher. As a densifier is ill-suited for such a task, a different piece of equipment needs to be brought in to perform the task. The same is true if the pile, either pre-crushed or post-crushed, needs to be moved so as to gain access to the worksite whereat the pile is presently located. Oftentimes, the new equipment is a bucket-laden excavator. As such, two pieces of rather expensive equipment must be employed to deal with the pile of concrete or rocks which increases the overall job costs and typically increases the time to completion.

What is needed is a piece of equipment that can crush large pieces of rock, concrete, or other material, yet is able to effective manage the material either in a pre-crushed or post-crushed state. Such a device must be able to task the power of an excavator for the crushing phase without loss of cycling time relative to a densifier. Such a device must be able to manage the material at the job site including be able be able to effectively load material into a dump truck or be able to move material from one location to another at the job site. Advantageously, such a device must not be unduly expensive to produce and maintain.

SUMMARY OF THE INVENTION

The rock crusher system for an excavator of the present invention addresses the aforementioned needs in the art by providing a rock crusher that draws on the power of an excavator to crush rocks, concrete and other material without loss of cycling time relative to a densifier. The rock crusher system, being a bucket based system is able to effectively and efficiently manage the material at the site including be able to load the material into a dump truck or other vehicle or move material from one location to another. The bucket based nature of the rock crusher system allows the system to have the versatility of a standard excavator employing an OEM bucket thereon, including being able to push or pull as yet unbroken ground without reducing the speed of rotation of the bucket and its teeth. The rock crusher system is price compatible with an OEM bucket system.

The rock crusher system for an excavator of the present invention is attached to a typical excavator that has a swing boom, an extension arm attached to the swing boom, and a bucket attached to the extension arm. The rock crusher system comprises one or more bucket blades that are fixedly attached within an interior of the bucket and are oriented generally parallel with the sides of the bucket. One or more anvils are fixedly attached to the extension arm proximate the distal end on a swing boom facing surface of the extension arm and such that the contact end of the anvils faces toward the interior of the bucket when the bucket is rotated toward the anvil. One or more generally parallel hinged blades each have an upper end that is pivotally attached to the extension arm above the anvil. The hinged blades also having an opposing lower end with a crushing surface thereon a medial section between the upper end and the lower end. A linkage has a first end that is pivotally attached to the swing boom and also has a second end pivotally attached to the medial section end of the hinged blade. The hinged blade is attached to extension arm via a bracket such that the bracket is fixedly attached to the extension arm. As the rock crusher system uses a bucket that is similar to an OEM excavator bucket, the rock crusher system is versatile in that, in addition to being able to perform a crushing operation like that of a densifier, the present invention has the ability to effectively manage material and perform tasks to a standard bucket excavator including pushing or pulling of material, loading material, digging into the ground, etc. This is due to the fact that the bucket of the rock crusher system, by extension of the overall boom, is capable of having its teeth generally perpendicular to the ground and thus be able to push, pull, dig, scoop, etc.

BRIEF DESCRIPTION OF THE DRAWINGS

Similar reference numerals refer to similar parts throughout the several views of the drawings.

DESCRIPTION OF THE PREFERRED EMBODIMENT

Figure 1:
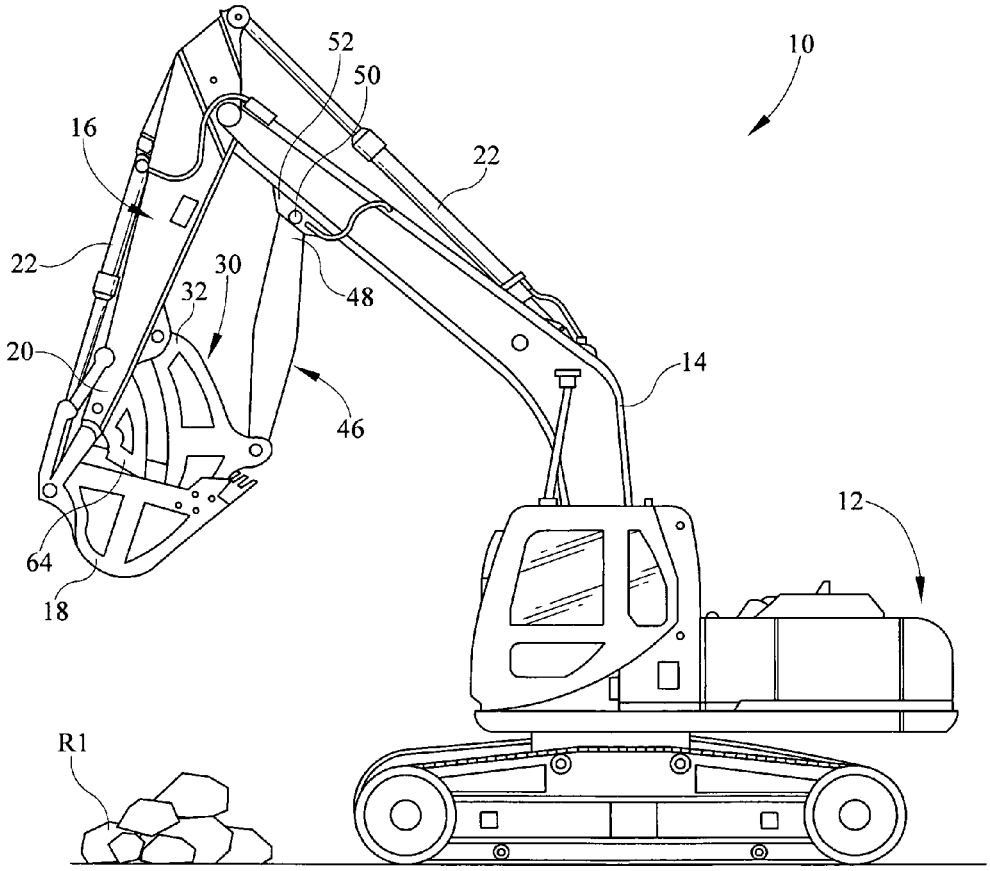
FIG. 1 is an environmental view of the rock crusher system for an excavator of the present invention.
Figure 2:
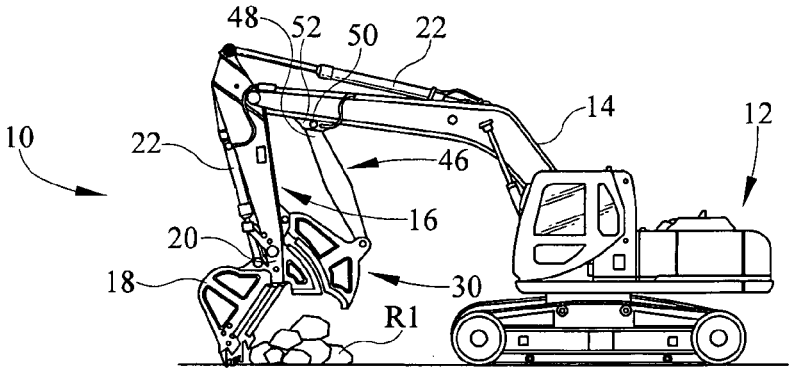
FIGS. 2-4 illustrate a complete rock crushing cycle from load retrieval, through load crushing, and to load discharge.
Figure 3:
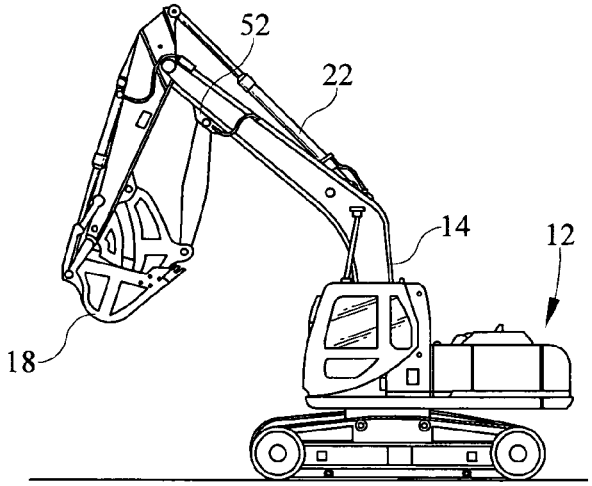
Figure 4:
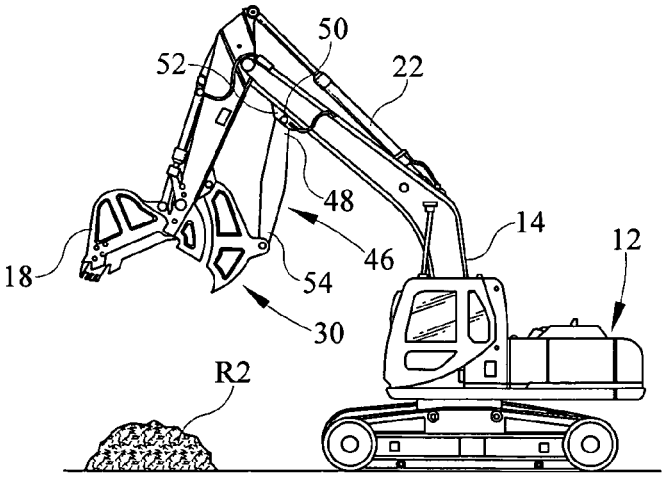
Figure 5:
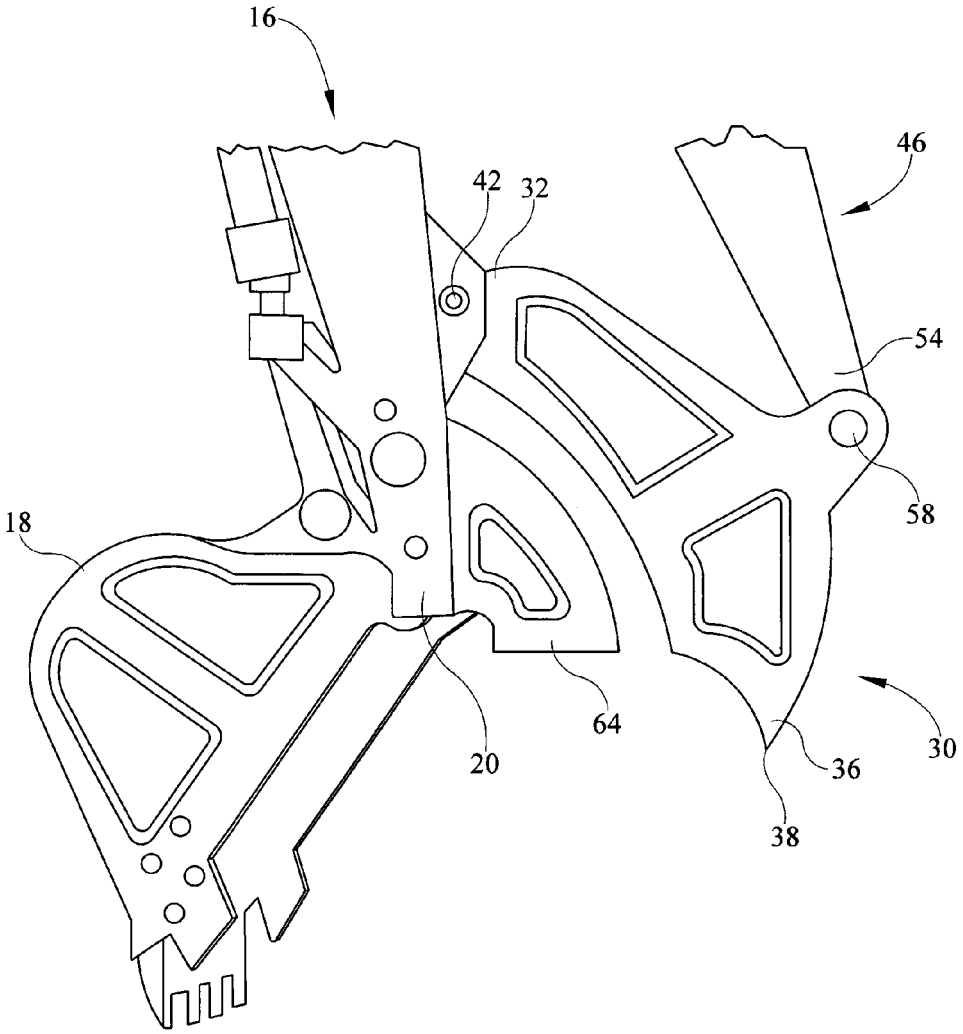
FIG. 5 is a plan view of the main crushing components of the rock crusher system for an excavator.
Figure 7:
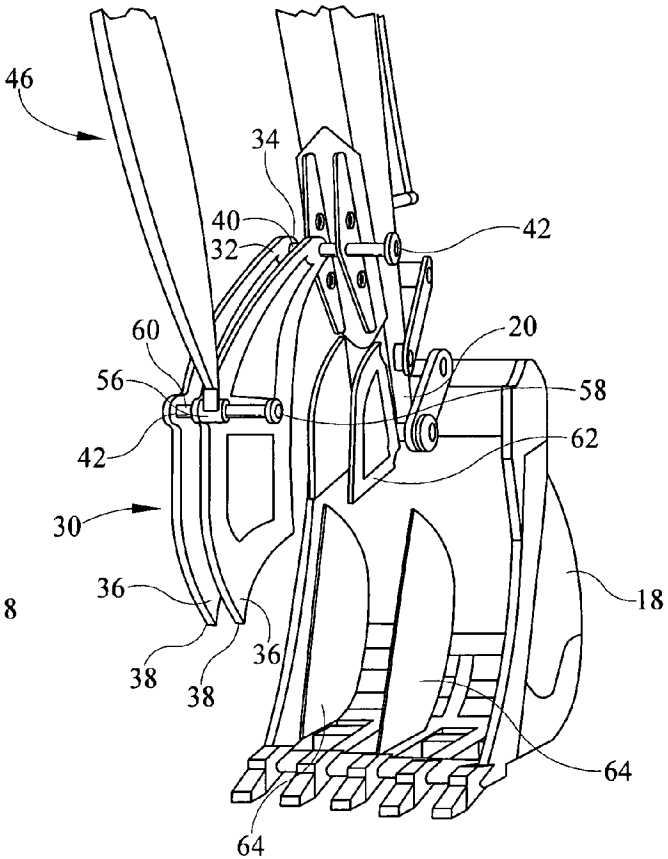
FIG. 7 is a perspective view of the main crushing components of the rock crusher system for an excavator with some of the crushing teeth not illustrated for brevity and clarity in order to illustrate the anvil.
Figure 6:
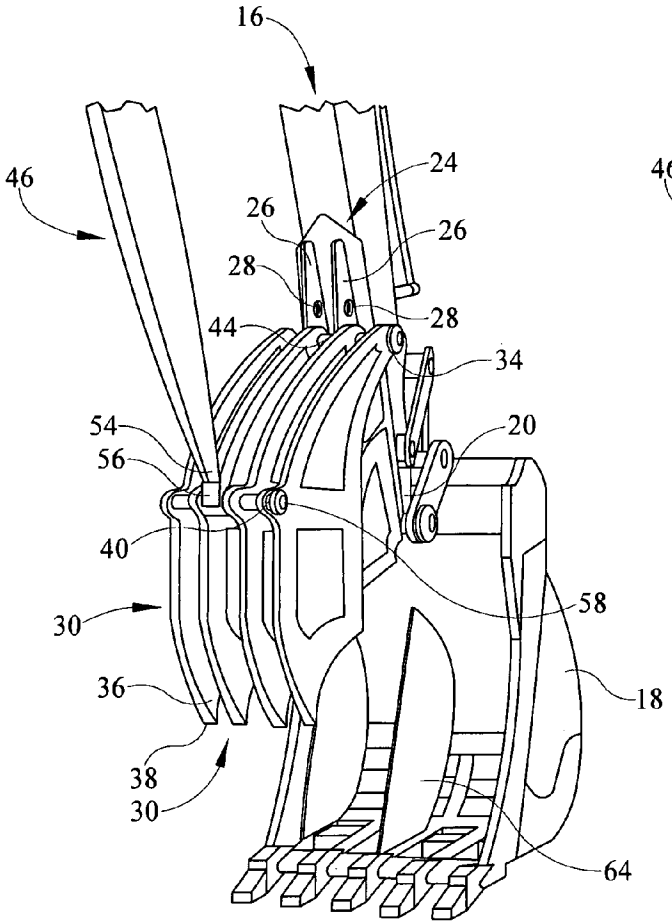
FIG. 6 is a perspective view of the main crushing components of the rock crusher system for an excavator.

Referring now to the drawings, it is seen that the rock crusher system for an excavator of the present invention, generally denoted by reference numeral 10, is comprised installed on a typical excavator 12 that has a swing boom 14 with an extension arm 16 pivotally attached to the swing boom 14 and a bucket 18 is located on the distal end 20 of the extension arm 16. Various hydraulic drives 22 are provided in order to control articulation of the swing boom 14, the extension arm 16 and the bucket 18, with the hydraulic power for the various hydraulic drives 22 being provided by the engine (not illustrated) of the excavator 12 as is typical for these types of machines.

A bracket 24 is attached, via bolts, welding, etc., to the extension arm 16, just above the distal end 20 thereof, on the excavator side (the side of the extension arm 16 that generally faces toward the excavator 12 whenever the distal end 20 of the extension arm 16 faces generally downwardly). One or more extensions 26 coextensively extend upwardly from the bracket 24 and each has one or more first openings 28 that each correspond with an opening 28 on the other extension 26. A series of hinged blades 30 each have a first end 32 that has a second opening 34 thereon and a second end 36 with a point 38 thereon, while a third opening 40 is located medially of the first end 32 and second end 36. Each hinged blade 30 is attached to the bracket 24 by placing each hinged blade 30 on one side of one of the extensions 26 in order to allow each extension 26 to hold each blade pair in spaced apart fashion, and aligning the second opening 34 on the first end 32 of the hinged blade 30 with a first opening 28 on one of the extensions 26 and passing an appropriate first pin 42 through the various aligned first openings 28 and second openings 34 and securing the first pin 42 in appropriate fashion. A first spacer 44 encircles the first pin 42 between adjacent hinged blades 30 in order to keep the hinged blades at a constant separation from one another. By having more than one first opening 28 on each of the extensions 26, allows for adjustment the respective angle between the hinged blades 30 and the bucket 18.

As seen, a linkage 46 has a first end 48 that is pivotally attached to the swing boom 14 by passing a second pin 50 through aligned openings located on a bracket 52 that is attached (via bolts, welding, etc.,) to the swing boom 14 and located on the first end 48 of the linkage 46, the second pin 50 being secured in appropriate fashion. The linkage 46 has a second end 54 that has a spacing collar 56 thereon. The third openings 40 on the hinged blades 30 are aligned with one another and with the spacing collar 56 and a third pin 58 is passed through the various openings and secured in appropriate fashion. Second spacers 60 are provided and encircle the third pin 58 between adjacent hinged blades 30 that are not separated by the spacing collar 56 in order to space the hinged blades 30 apart. The width of the first spacer 44, the second spacers 60 and spacing collar 56 as well as the thickness of each extension 26 are all substantially equal in order to hold the hinged blades 30 parallel to one another and equidistant to one another, although the equidistance is not necessary so long as the hinged blades 30 are all parallel to one another (each spacing element first spacer 44 or thickness of extension, spacing collar 56, second spacer 60 is equal for adjacent hinged blades 30).

By using the first pin to attach the first end 32 of the hinged blades 30 to the bracket 26, using the second pin 50 to attach the first end 48 of the linkage 46 to the swing boom 14, and using the third pin 58 to attach the second end 54 of the linkage 46 to a medial portion of the hinged blades 30, allows the hinged blades 30 to pivot with respect to the bucket 18.

Attached to the distal end 20 of the extension arm 16 is one or more spaced apart anvils 62 which are fixed in place by appropriate means.

Located within the bucket 18 are a series of spaced apart bucket blades 64 that are fixed in place by appropriate means.

The various components of the rock crusher system 10 are made from the same or similar materials used to make the other respective components of the excavator 12.

In order to use the rock crusher system for an excavator 10 of the present invention, the process for crushing large rocks R1 (or other materials) begins in a typical excavator 12 gathering step such that the bucket 18 is positioned beyond the large rock material R1 and is dragged back to scoop up the material R1 into the bucket 18. The operator then pulls back on the control stick to begin the crushing process. As the bucket 18 is rotated toward the extension arm 16, the material R1 within the bucket 18 become engaged with the anvils 62 as well as the hinged blades 30 which press on the rock material R1 on one surface with the bucket blades 64 pressing on an opposing surface. With continued bucket 18 rotation comes increased crushing pressure. Coincidentally, as the stick is being pulled back, the extension arm 16 is being articulated toward the swing boom 14 thereby putting even more force onto hinged blades 30 into the bucket 18 thereby putting additional crushing force on the rock material R1. Once the rock material R1 is crushed into smaller sized material R2, the operator's control stick is moved out thereby releasing the hinged blades 30 from the bucket 18 allowing the rock material R2 to be deposited. By using anvils 64 and the bucket blades 62, crushing force is exerted on the rock material R1 via bucket 18 rotation. By having the additional hinged blades 30, substantial additional crushing force is exerted by the hydraulics used to articulate the extension arm 16 with respect to the swing boom 14.

By employing hinged blades 30 that are adjustable along a portion of the longitude of the extension arm 16, the angle of attack of the hinged blades 30 with respect to the bucket 18 can be adjusted for specific suitability depending on the material R1 to be crushed by the rock crusher 10.

While the invention has been particularly shown and described with reference to an embodiment thereof, it will be appreciated by those skilled in the art that various changes in form and detail may be made without departing from the spirit and scope of the invention.

I claim:

1. A material crusher for use on an excavator, the excavator having a swing boom, an extension arm having a proximal end attached to the swing boom and a distal end having a bucket attached thereto, the material crusher, in combination with the swing boom, the extension arm, and the bucket, comprising:

a bucket blade attached within an interior of the bucket;

an anvil attached to the distal end of the extension arm on a swing boom facing surface of the extension arm;

a hinged blade pivotally attached to the extension arm above the anvil.

2. The material crusher as in claim 1 wherein the bucket blade is fixedly attached to the bucket.

3. The material crusher as in claim 1 wherein the hinged blade is attached to the extension arm via a bracket, the bracket fixedly attached to the extension arm.

4. The material crusher as in claim 1 further comprising a linkage having a first end pivotally attached to the swing boom, the linkage also having a second end pivotally attached to the hinged blade.

5. A material crusher for use on an excavator, the excavator having a swing boom, an extension arm having a proximal end attached to the swing boom and a distal end having a bucket attached thereto, the material crusher, in combination with the swine boom, the extension arm, and the bucket, comprising:

a bucket blade adapted to be attached within an interior of the bucket;

an anvil adapted to be attached to the distal end of the extension arm on a swing boom facing surface of the extension arm;

a hinged blade having an upper end pivotally attached to the extension arm above the anvil, the hinged blade having an opposing lower end with a crushing surface thereon, and the hinged blade having a medial section therebetween; and a linkage having a first end adapted to be pivotally attached to the swing boom, the linkage also having a second end pivotally attached to the medial section of the hinged blade.

6. The material crusher as in claim 5 wherein the bucket blade is fixedly attached to the bucket.

7. The material crusher as in claim 5 wherein the hinged blade is attached to extension arm via a bracket, the bracket fixedly attached to the extension arm.

* * * * *